United States Patent [19]

Milnes et al.

[11] Patent Number: 5,076,800

[45] Date of Patent: Dec. 31, 1991

[54] SHIELDED IMPEDANCE-CONTROLLED IDC CONNECTOR

[75] Inventors: Glan A. Milnes, Laveen; James C. Ainsworth, Chandler; Theodore Jensen, Scottsdale, all of Ariz.

[73] Assignee: W. L. Gore & Associates, Inc., Newark, Del.

[21] Appl. No.: 692,424

[22] Filed: Apr. 29, 1991

[51] Int. Cl.[5] ..... H01R 4/24
[52] U.S. Cl. ..... 439/394
[58] Field of Search ..... 439/389–425

[56] References Cited

U.S. PATENT DOCUMENTS 3,543,222 11/1970 Rheinfelder ..... 439/394
4,632,486 12/1986 Hasircoglu ..... 439/394

*Primary Examiner*—Joseph H. McGlynn
*Attorney, Agent, or Firm*—Gary A. Samuels

[57] ABSTRACT

A shielded impedance-controlled insulation displacement contact connector and an assembly of the connector with a shielded ribbon cable and a PCB, having properties equivalent to those of terminated coaxial cables as to shielding from cable to PCB, impedance matching of connector to cable, signal-to-signal isolation of signal conductors, shield grounding from cable to PCB, and isolation of each conductor and each tine in the termination area of the connector.

8 Claims, 7 Drawing Sheets

SHIELDED IMPEDANCE-CONTROLLED IDC CONNECTOR

FIELD OF THE INVENTION

The invention relates to the field of shielded connectors for terminating shielded flat or ribbon electric signal cables for attachment to printed circuit boards (PCB'S).

BACKGROUND OF THE INVENTION

For both commercial and test applications there is a need to be able to feed electric signals from a flat or ribbon cable through a connector to PCB circuitry. High quality signal transmission has been difficult to achieve because of stringent signal performance requirements coupled with the constraints of limited space requirements both in the connector and on the board.

Various designs of ribbon cable have been used, such as a row of insulated signal cable imbedded in a strip of insulation with a sheet of conductive shielding placed on one side of the strip of insulation or a sheet or strip of conductive shielding material placed on both sides of the insulation. Neither arrangement addresses the well-known problem of line-to-line cross-talk between the individual signal conductors within a cable.

It is also known to arrange alternating signal and ground conductors in the insulation of a cable with shielding on one or both sides of the strip of insulation bearing the signal and ground conductors. This arrangement of ground and signal conductors and their shielding is not adequate to control cross-talk among the various conductors. Impedance within the cable is also not controlled, except within broad limits, the range of impedance depending on the materials used in the cable and the spacing and dimensions of the various parts, for example. To achieve better signal transmission quality than available in the above cables, one has been required to resort to coaxial signal cables, wherein each signal conductor is individually shielded from outside electrical influences and any signals being transmitted within a conductor are shielded from leaking outside the cable as well. The space required for coaxial cables is greater than for unshielded signal transmitting conductors and terminating them to connectors properly requires much more complicated connectors which are usually larger, much more expensive to manufacture, and time consuming and expensive to execute the termination process thereon. Many of the resulting terminated coaxial cables are too bulky to fit into required small spaces on PCB's for connection.

Most of the problems cited above which pertain to the construction and properties of the ribbon cable itself may be solved by use of a shielded ribbon cable wherein each signal conductor is insulated by porous expanded polytetrafluoroethylene polymer, such as that described in U.S. Pat. Nos. 3,953,566, 3,962,153, 4,096,227, 4,187,390, 4,902,423, and 4,428,665. As a unit, the insulated signal conductors are shielded by a conductive metal shield on each side of the plane of the row of signal conductors and a protective layer of polymer jacketing placed, usually by extrusion, on the outside of the shielding. The jacketing, shielding, and insulation between each signal conductor is flattened or compressed to leave a narrow web of material between each signal conductor along its length, of about four mills thickness, for example. The inclusion of shielding in the webs and the virtual squeezing out of insulation between the layers of shielding of the webs essentially eliminates line-to-line cross-talk between the signal conductors of the ribbon cable to give a cable having near coaxial cable electrical and signal performance levels. IDC signal conductor contacts can be used to terminate the conductors of the cable while retaining near coaxial performance.

The present invention provides a connector which, when used to terminate the above cable, will overcome the problems outlined above without use of coaxial cable shielding.

SUMMARY OF THE INVENTION

The invention provides a connector for terminating shielded flat or ribbon electric signal cables, comprising an elongated body preferably formed from a solid block of conductive metal, having inlet in it and passing through it along its length one or more rows of a first set of closely spaced apertures in which are housed conductive metal IDC tines for making electrical contact with the signal or ground conductors of a flat or ribbon electric signal cable. The tines are shaped so as to have the form of a pin or socket on one end and a pair of IDC blades formed on the other end. Other useful forms of tines may include tines rolled into tube form having a notch and slit on one end of the tube and a pin inserted into the other end of the tube. The bottom end of the tube may be rolled tightly into the shape of a pin. A simple double-ended pin may be used for a tine with a tube being fitted onto the top end of the pin, the tube being notched and slit, for example, to hold a conductor. The top of the tube may be flattened or crushed and formed into a pair of IDC blades. Each tine is partially embedded in a cylinder of plastic or rubber insulation which seats and centers the tine within an aperture in the body of the connector in position to contact an insulated center conductor or a drain conductor of a ribbon cable laid in proper position across the IDC blades of the tine. The insulation partially surrounding the metal tine both insulates the tine from the metal body of the connector and holds the tine in position for IDC connection to a cable conductor. The pin of the tine extends below the body of the connector to fit into connection apertures in a printed circuit board (PCB) to connect to signal or ground leads as may be selected for mating with a connector of the invention.

A second set of apertures for accommodating connector dowels, pins or rods may be inlet into the body of the connector at appropriately spaced locations to provide a means for joining the body to other parts of the connector.

A portion of the body may extend to one side of the body in order to support a flat or ribbon cable at the point it enters the body for termination and to provide a ground contact with the body to a folded back layer of shielding of the ribbon cable being supported by the body.

The first set of apertures in the body for housing a tine are offset for part of their length from the remainder of the length of the aperture in order to accommodate the off-center shape of the preferred form of tines to keep each tine spaced away from contact with the body and to aid by the holding effects of the offset the holding of the tine and the insulation surrounding it in its place in the aperture.

A conductive, preferably metal, cover plate is provided over the tine area of the connector, the cover plate having a partial box shape with space over each tine and conductive metal spacers formed between each tine that protrudes above the body into the tine cover plate. The result is that each tine is shielded from each other tine along its entire length within the body and the tine cover plate in order to eliminate so far as is possible any line-to-line cross-talk between the tines and the signal or ground conductors terminated to and contacting them. The wall surfaces of the spacers of the cover plate may be lined with insulation by coating them or by laying a sheet of insulation, such as polyimide or polyvinyl chloride, over the IDC tines, pushing them through the sheet. The edges of cut insulation thus extend upwardly into the spaces surrounding the IDC tines and any conductors terminated to them. The top portions of the tines may also be coated with insulation to aid in preventing contact between the tines and the walls of the tine cover plate.

A flat planar slot is inlet into the bottom side of the cover plate in alignment with the portion of the cover plate extending outwardly from one side of the cover plate to house and provide space for a ribbon cable being terminated to the IDC contact tines housed within the body of the connector and extending across the rows of the first set of apertures to or near the opposite side of the body. A ribbon cable housed within the slot may extend to the outer wall of the cover plate or may pass through the side of the cover plate. When the slot has a wall at the end and is closed instead of being open, a small narrow strip of insulation is fitted into the slot adjacent the wall to provide insulation against or prevent conductive contact of the ends of the conductors of the ribbon cable with the conductive wall of the cover plate. Rather than IDC terminated, a ribbon cable could alternatively be stripped to expose the shielding, which is folded back as for IDC termination, then the signal conductors stripped of insulation and soldered to the ends of IDC contact tines. The same shielding would be provided by the connector of the invention to the signal conductor-tine soldered connection area as for an IDC termination.

Apertures are inlet into or perforate the body of the connector and the tine cover plate which house alignment pins for attaching the body and the cover plate to each other. Instead of apertures and pins, one could also use latching means, adhesive, welding, soldering, or in the case of a metal coated plastic tine cover and body, ultrasonic bonding. In the preferred form, round apertures are mated with square pins of a slightly larger corner-to-corner cross-section than the round apertures in order that a firm fit and secure attachment can be achieved. Along the side top edges of the cover plate is preferably provided a small ledge or bead to aid, in conjunction with a latching means, the holding of the connector to a PCB.

An alternative construction of the body of the connector can be used for manufacturing convenience. The body can be formed in two parts instead of the one part described above. A thinner form of body having ordered rows of apertures passing through it top to bottom can be attached to a flat plate also having ordered rows of apertures passing through it top to bottom, but fitting on the top of the first section of body such that each aperture is offset from the one below it a specified amount or distance such that the offset shaped tine which occupies each aperture fits into the mated set apertures in a fashion to leave an approximately equal clearance space surrounding all portions of each tine. The two sections of body bearing offset apertures may be aligned with each other and attached to each other by the alignment pins set into each end of the body or they may be welded, brazed, adhered by adhesive, or other ways well known in the art for attaching pieces of metal or metal-plated plastic together.

A latching means may be used to hold a terminated cable and connector to a PCB. A plastic or metal connector receiver frame, which is attached or attachable to a PCB is set into place on the PCB in alignment with the length of the connector to be attached to that point on the PCB. The connector receiver comprises a frame for surrounding the bottom portion of the body of a connector on four sides and two retaining clips which pivot around pins set in place in the frame such that when a connector is set in place within the connector receiver frame and in proper contact electrically with the PCB, the retaining clips hold in place the connector onto the PCB. The connector receiver frame may be made in one piece or from end pieces and side pieces attached to each other by brazing, soldering, adhesive, or other known means and its dimensions selected to match those of the connector to be held therein. The lower end of the clip adjacent the PCB may cooperate or coact with a notch set into the corner of the connector housed in the clips and frame to aid in removing the connector from the PCB when it is desired to do so. The upper end of each clip, which is formed of springy metal, is shaped to fold over the top of the connector when it is in place in the connector receiver frame to hold the terminated connector firmly in place with aid of the ledges or beads formed thereon. Other forms of releaseable receiver or holder may be utilized to hold the terminated cable onto the PCB, including well known forms of plastic retaining shapes and clips.

DESCRIPTION OF THE INVENTION

The invention is now described in terms of the accompanying drawings to more clearly describe the connector and assembly of the invention.

Figure 1:
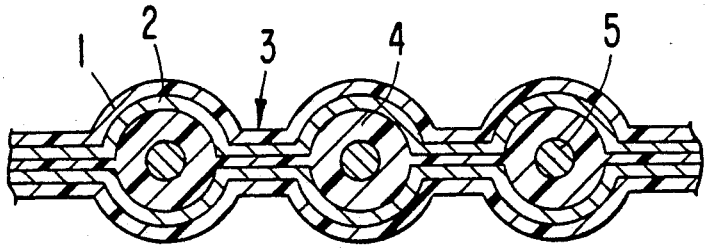
FIG. 1 provides a cross-sectional view of a section of a shielded ribbon cable suitable for termination by a connector of the invention.

FIG. 1 shows a cross-section of a typical shielded signal cable of a type which the connector of the invention may be useful for terminating. Electric signal conductors 5 are surrounded by insulation 4, electrically conductive shielding material 2, and polymeric jacket material 1, and those portions of the material between conductors 5 is pressed into narrow webs 3 which also contain layers of jacket 1, shielding 2, and insulation 4. The webs 3 cause the signal conductors 5 to be evenly spaced and contain a minimum amount of insulation 4 between shielding layers 2.

Figure 2:
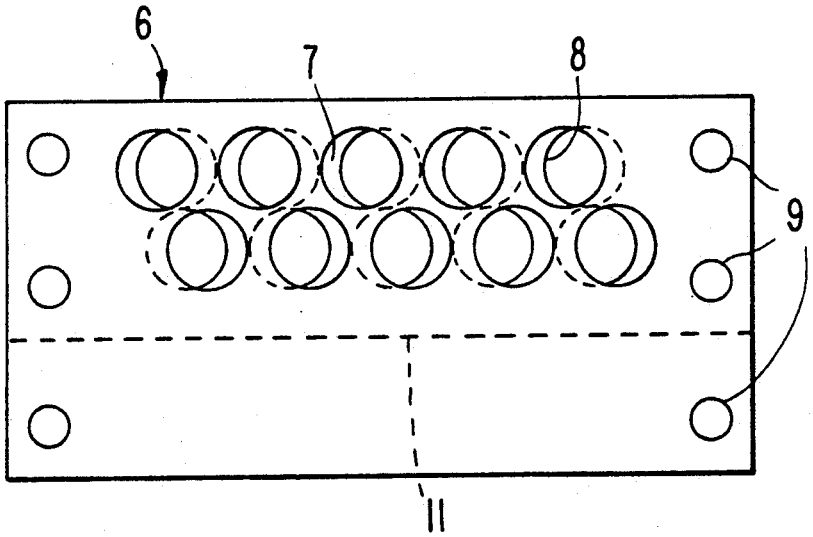
FIG. 2 shows a top view of the body of a connector of the invention.

FIG. 2 displays a top view of the body 6, the top portion 7 of the apertures through body 6 being shown by solid circles and the bottom portion 8 of the apertures through body 6 of the connector being shown partially in dotted lines. Apertures 9 are inlet into body 6 to house holding pins which hold body 6 in attachment to tine cover plate 12 (shown in FIGS. B and 7). Usable holding pins may be cylindrical or preferably square in cross-section, the square pins being slightly oversize for the apertures so that a small amount of distortion of the square edges of the square pins on insertion into apertures 9 will result in a firm attachment of body 6 and tine cover plate 12. The back edge line of the bottom side of body 6 is shown by dotted line 11 in its obverse relationship to the side of body 6 being displayed in FIG. 2.

Figure 3:
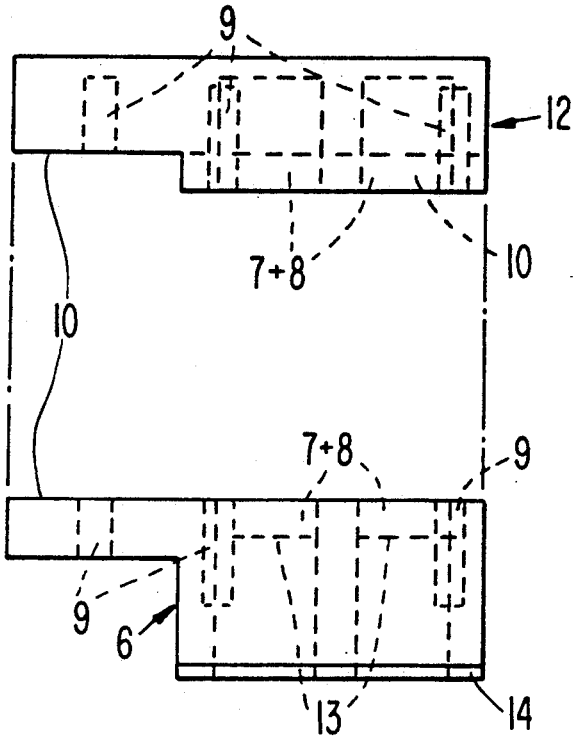
FIG. 3 describes a side view of the body and tine cover plate of a connector.
Figure 6:
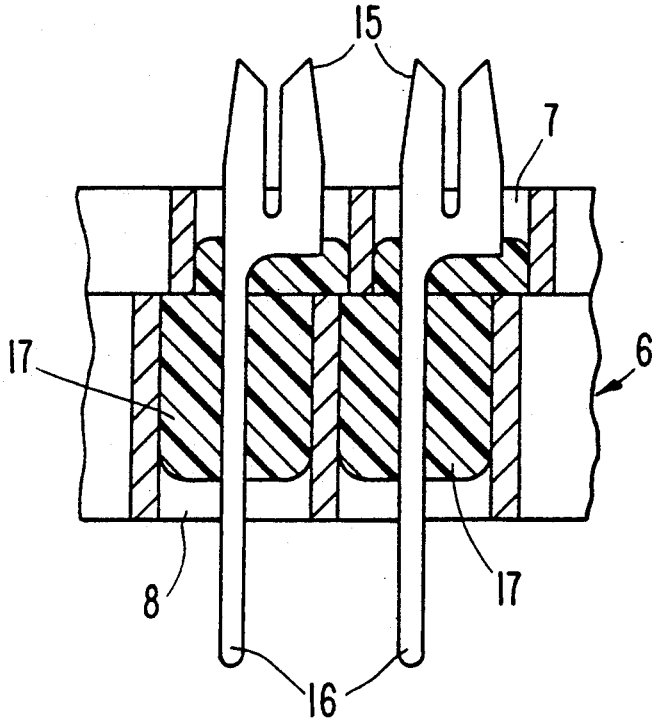
FIG. 6 describes in cross-sectional view tines aligned in place in their apertures and imbedded in insulation.
Figure 9:
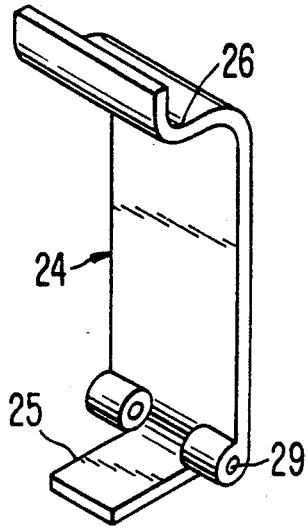
FIG. 9 shows a perspective view of a connector retaining clip.

FIG. 3 describes side views of tine cover plate 12 and connector body 6 in position and above the other for fitting together after termination of a coaxial cable to body 6. Apertures 9 to house holding pins and top and bottom portions 7 and 8 are shown by dotted lines as is part of line 10, which is the edge of a slot inlet into tine cover plate 12 to house and hold a ribbon cable body within tine cover plate 12. Offset line 13 shows the point at which the offset occurs between the top portion 7 and the bottom portion of the apertures 8 through body 6 in which are set the IDC tines 15 in their insulation 17 (as shown in FIG. 6). Along the bottom side edge of body 6 is shown a jacking notch 14 which is inlet into that edge for cooperation with a retaining clip 24 (shown in FIGS. 9 and 10) which aids in removal of the connector terminated to a coaxial cable from a PCB to which it has been mated.

Figure 4:
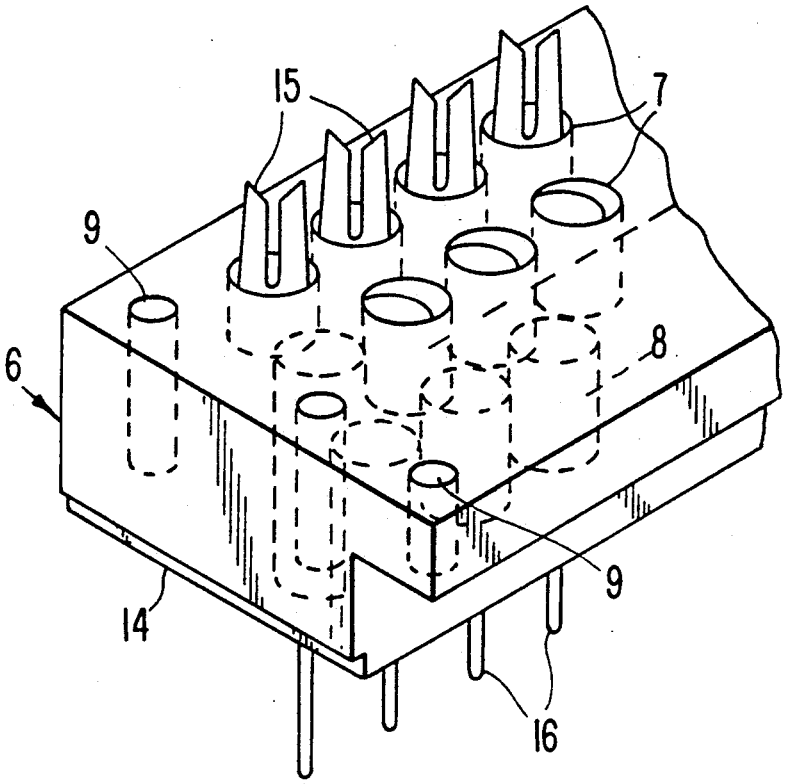
FIG. 4 displays a perspective view of a section of the body of the connector with some tines in place in apertures in the body.

FIG. 4 is a partially cut away perspective view of body 6 of the connector showing tines 15 in place in a row of apertures within body 6, the pin ends 16 of tines 15 appearing below the bottom plane of body 6. Apertures 7, 8, and 9 are shown in proper position as is jacking notch 14.

Figure 5:
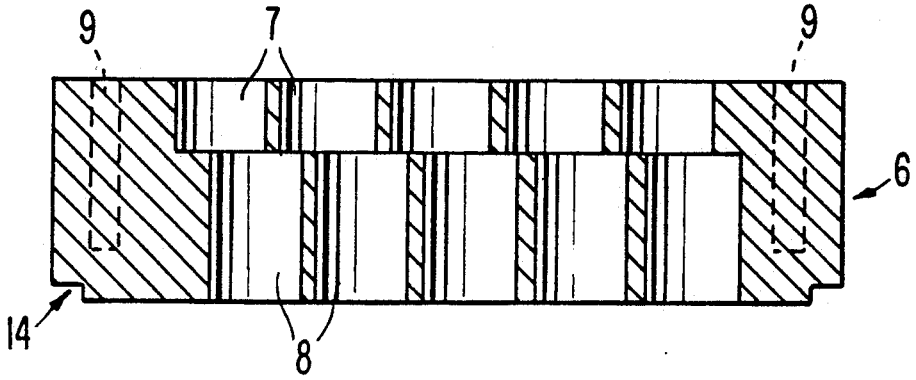
FIG. 5 shows in cross-sectional view the body of a connector including the offset apertures to house the IDC connector tines and the apertures to house pins which hold the tine cover plate to the body.

FIG. 5 provides a front cross-sectional view of body 6 along a line of apertures, wherein the relationship and spacing of the top portion 7 and bottom portion 8 of each aperture intended to house a tine 15 embedded in its insulation 17 is shown along with the apertures 9 to house holding pins and jacking notches 14 on each side bottom edge of body 6.

FIG. 6 displays in a cross-sectional view a pair of tines 15 embedded in insulation 17 within apertures with bottom portion 8 thereof shown offset from top portion 7 of each aperture.

Figure 7:
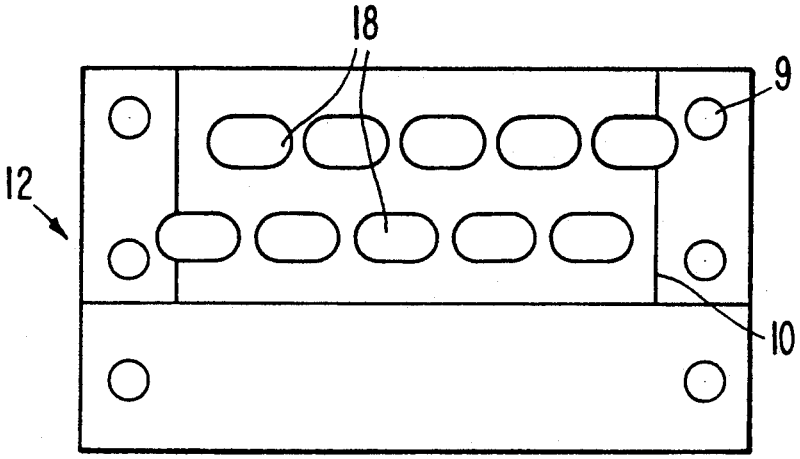
FIG. 7 displays a bottom view of the tine cover plate with apertures partially penetrating the cover plate to provide space for the tops of the tines bearing the IDC connector clips and the conductors terminated to them so that tines and plate do not come into electric contact and are electronically shielded.

FIG. 7 is a bottom view of tine cover plate 12 displaying apertures 9 to house holding pins and edges 10 of a slot inlet into the bottom of tine cover plate 12 to provide space for housing the shielded ribbon cable which is terminated to the connector. Clearance apertures 18 are shown inlet into the lower surface of tine cover plate 12 to provide clearance volume for clearance between the tops of tines 15 and tine cover plate 12 when tines 15 and the ends of the ribbon cable are terminated to each other.

Figure 8:
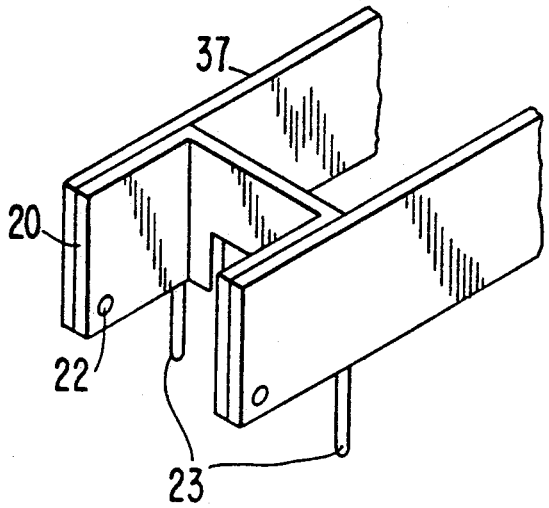
FIG. 8 depicts in a perspective end view connector receiver frame for holding to a PCB a connector retaining clip which holds a connector mated to the PCB.
Figure 10:
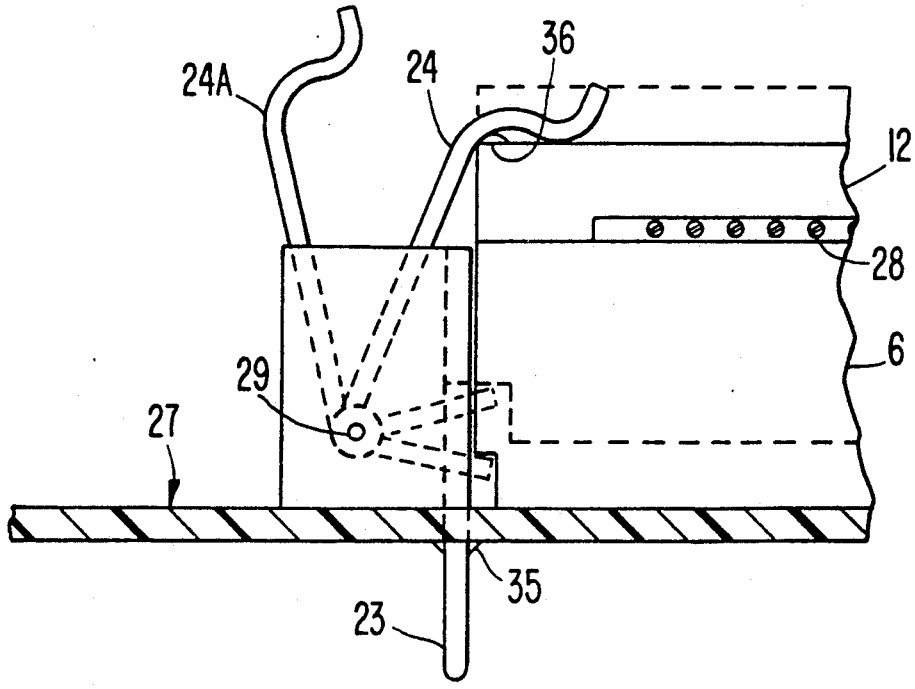
FIG. 10 describes in a partial cutaway cross-sectional view a connector retaining clip in place in the receiver frame and holding a connector in place on a PCB.

FIG. 8 describes in a partial perspective view one of a connector receiver frame 20, including side pieces 37, which plugged into apertures for that purpose in a PCB at the proper spacing to house the connector of the invention, surround, support, and help hold in place the connector in cooperation with and in combination with a pair of retaining clips 24 (shown in FIG. 9 in a perspective view) held into place in the frame by small metal or plastic pins through apertures 22 and 29, set respectively in the connector receiver frame and retaining clip 24. Clips 24 and connector receiver frame 20 cooperate as shown in FIG. 10 to hold the connector in place by the upper curved portions of clips 24 in place on top of the connector over bead 36. When it is desired to remove the connector from PCB 27, the clips 24 are pulled away from each side of the connector into the position shown by 24A as shown in FIG. 10. Lifting toe 25 of clip 24 pivots on a pin set in apertures 22 and 29 of the connector receiver frame and clip to exert pressure into jacking notch 14 of body 6 to gently push body 6 away from PCB 27 for easy removal of the connector from PCB 27. A slot 21 of predetermined width and height is cut from or molded into the side of connector receiver frame 20 facing the connector it houses. The height and width of slot 21 is such that toe 25 will easily move in slot 21 to a height, controlled by the height of slot 21, to aid in loosening the connector from its implacement on PCB 27 in contact with the predetermined circuits therein. Connector receiver frame 20 and clip 24 may be made from metal or plastic as useful and desired and may be made from one piece of metal, such as by die-casting, for example. A convenient means to make clip 24 is to mold it into shape while warm and moldable, slit the toe end of the clip into three parts, roll the end parts toward the clip to form apertures 29 for housing a pin, leaving lifting toe 25 at an angle of about 90° to the remainder of the clip to form the lifting toe 25. Apertures 29 may be drilled or otherwise placed in connector receiver frame 20 by means well-known in the art. Pins 23 are formed on the bottom edge of connector receiver frame 20 to fit into apertures on PCB 27 to hold the connector receiver frame in place on the PCB. Pins 23 may be anchored to PCB 27 by, for example, solder 35. Curved portion 26 of clip 24 is shaped to lie on top of a connector in place in connector receiver frame 20 to hold the connector in place on the PCB until such time as removal is desired, as discussed above.

Pins 23 provide a ground connection of the shield of cable 32 to tine cover plates 12 or 19, then to the PCB through clips 24 and connector receiver frame 20, all of which are electrically conductive.

Figure 11:
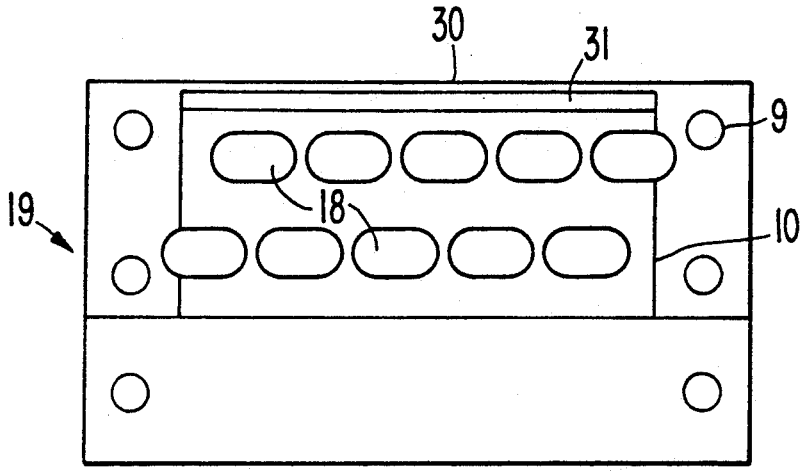
FIG. 11 displays the underside of an alternative form of tine cover plate which is closed at the end of the slot housing a ribbon cable at the end of the slot opposite the entrance of the ribbon cable and a bar or band of insulation affixed to the wall or closed end of the slot.

FIG. 11 describes a bottom view of an alternative form 19 of a tine cover plate wherein a closure wall 30, preferably formed from the material of the cover plate, closes off the end of the slot therein which provides space for housing a shielded ribbon cable to be terminated to the connectors. A layer of insulation 31 may be placed against bar 30 to insulate the cut ends of the signal conductors 5 and shielding 2 of the cable being terminated from contact with conductive metal bar 30.

Figure 12:
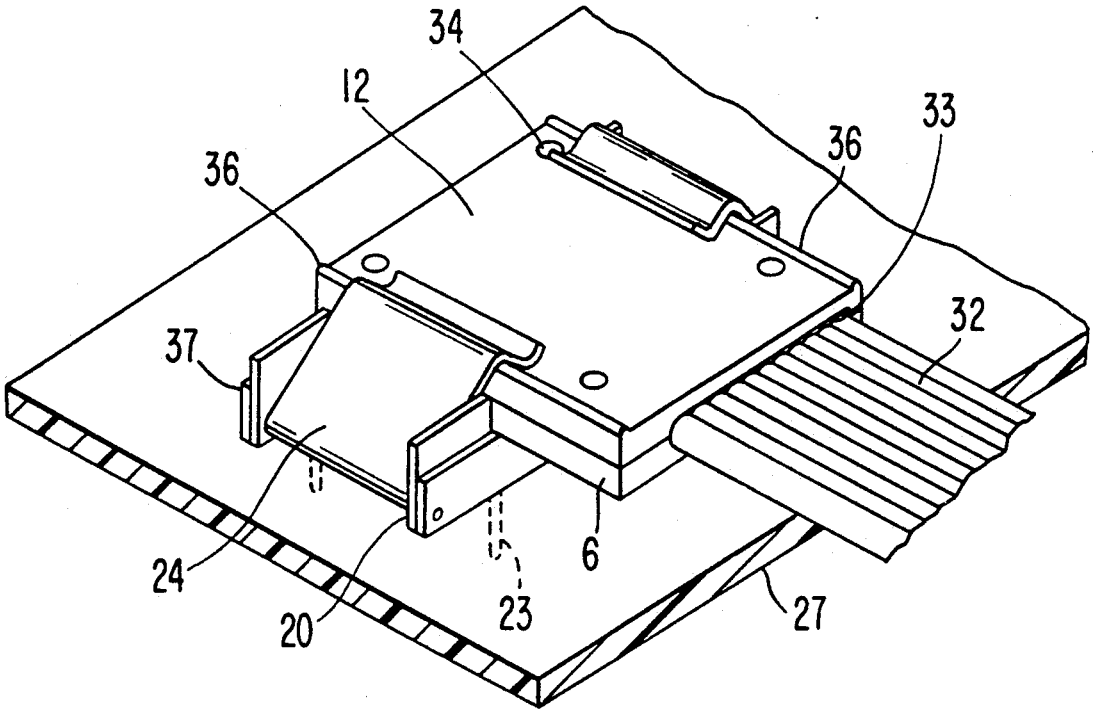
FIG. 12 describes in a perspective view an assembly of the invention, including a ribbon cable, a connector, and a pair of connector retaining clips and a receiver frame in place on a PCB.

FIG. 12 describes in a partially cut away perspective view an assembly of a shielded ribbon signal cable 32 terminated to a connector of the invention and the connector held in place by connector receiver frame 20 and clips 24 onto PCB 27. Cable 32 fits into slot 33 (shown by edge lines 10 in other figures). The tine cover plate 12 is held in place on body 6 by pins 34 set into apertures 9 provided in the cover plate and body. Both tine cover plate 12 and body 6 may be machined from or cast from an electrically conductive metal, for example, and may also be molded from a polymer material which is subsequently coated with some form of conductive metal by a method well-known in art.

Figure 13:
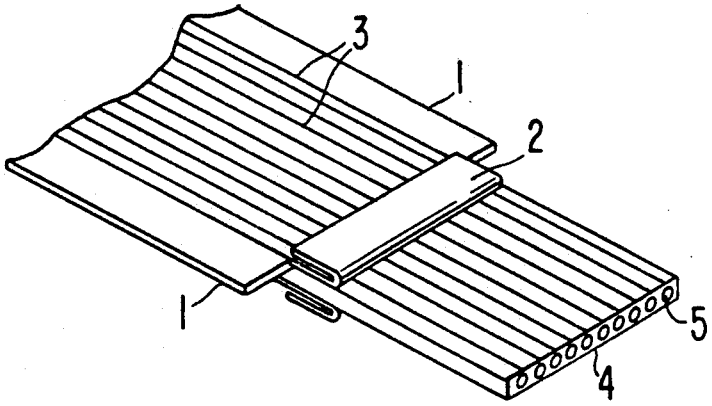
FIG. 13 shows a shielded electrical signal cable prepared for termination to a connector of the invention.
Figure 14:
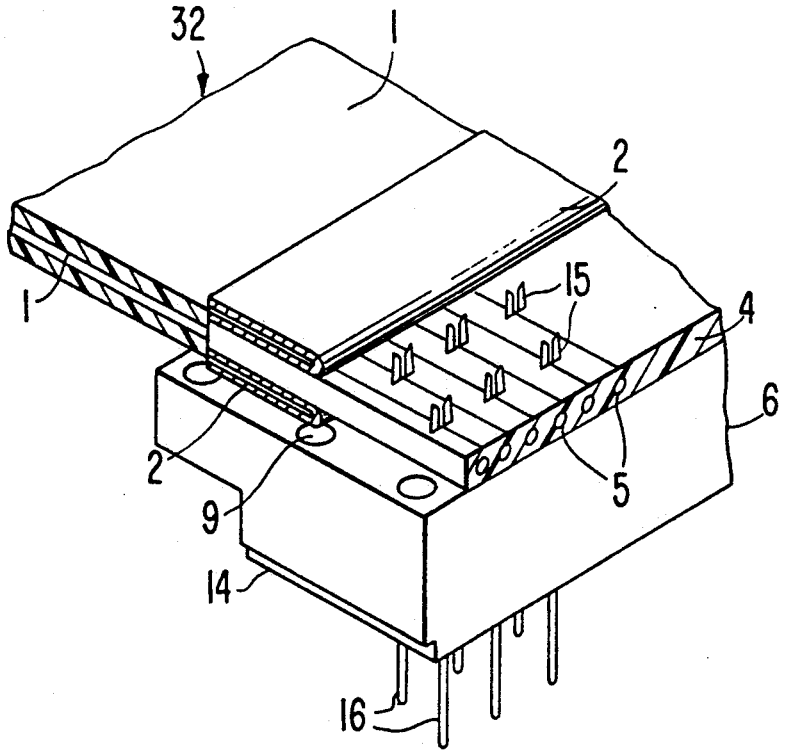
FIG. 14 depicts a shielded signal cable IDC terminated to the body of a connector of the invention.

In the procedure for terminating cable 32 to the IDC connector, jacket 1 is removed a short distance from the end of cable 32, shielding layers 2 peeled away from insulation 4 on both sides of cable 32 and folded back along the cable so as to contact conductive body 6 and tine cover plate 12 in order to ground the cable to the connector (see FIGS. 13 and 14). Conductors 5 in insulation 4 are then placed on the top of IDC tines 15 fitted within apertures 7 and 8 on body 6 and forced into place within the holding grooves of tines 15 to effect an IDC termination of the cable signal conductors 5 on tines 15. The cable end is even with the end of slot 33 opposite to the end they are inserted or rest against insulation 31 adjacent closure wall 30 in the alternative tine cover plate 19. Tine cover plate 19 or 12 (see FIGS. 7 and 11) is placed over the terminated cable 32 terminated to body 6 and pins 34 firmly inserted into apertures 9 of the body and cover plate to hold the body and cover plate together (see FIG. 12). The shielding layers 2 of the cable are now grounded to the body 6 and attached tine cover plate 12. Alternatively a tag of shielding 2 may be terminated to one of IDC tines 15 to be carried by its pin end 16 into the ground of the PCB to which the connector is mounted. The connector is then mated to the intended apertures of the PCB within the connector receiver frame 20 and the retainer clips 24 snapped into place over the top of the connector over beads 36 to hold it firmly in place on the PCB.

FIG. 13 shows how a ribbon cable is prepared for IDC termination on body 6. Jacket layer 1 is peeled away from a portion of the end of cable to be terminated, shielding layer 2 is peeled from insulation 4 surrounding signal conductors 5 and folded back a short distance on both sides along cable 32 against jacket 1. Cable 32 is then pressed onto IDC tines 15 such that tines 15 penetrate cable 32 as shown in FIG. 14 and make contact with conductors 5 in the slots of IDC tines 15 to effect termination of the cable as the tine cover plate 12 is fitted into place over cable 32 to body 6 and attached thereto by insertion of holding pins into apertures 9. Signals may now pass from conductors 5 through tines 15 to a PCB into which pin ends 16 of tines 15 are plugged.

The connector of the invention, when properly terminated to a shielded ribbon cable embodying signal and mixed signal and ground wires, can provide near coaxial cable performance while utilizing IDC contact termination with almost no line-to-line crosstalk in an impedance range of about fifty to one hundred ohms. The terminated connector is easily mated to a PCB and is easily removed from the PCB when it is desired to do so, being firmly held in place on the PCB by easily detachable and movable latching and hold-down means. The connector provides impedance matching of connector to ribbon cable, improved signal-to-signal isolation of each signal conductor from the cable through the connector into the PCB, has improved shield grounding through direct connection of the cable shields to the PCB ground plane through the connector, and shields the termination area completely to minimize radiated noise and reduce the susceptibility of the assembly utilizing it to external electrical influence. Better tine-to-tine isolation is also provided within the connector.

We claim:

1. A shielded impedance-controlled insulation displacement contact connector comprising:

(a) an electrically conductive body, including a top, a bottom, two opposing sides, a front, and a back, said body having one or more rows of closely spaced first set of apertures passing through said body, top to bottom, the top portion of each said aperture being offset from the bottom portion of each said aperture to accommodate and center within each said aperture an irregularly shaped insulation displacement contact tine and insulation surrounding said tine housed therein, and a second set of apertures inlet into said body for housing connecting means, said body connected to (b) a tine cover plate, having apertures for housing connecting means for connecting said plate to said body, said apertures inlet into said plate to provide space above said tines protruding into said plate from said body to which said plate is affixed, and a slot inlet into the bottom surface of said plate to accommodate and ground a ribbon coaxial cable;

(c) a multiplicity of insulation displacement tines surrounded at the middle portion of said tines by insulation and housed within said apertures in said body and protruding into said apertures in said cover plate, said tines having an offset irregular shape, including pins on one end and a pair of insulation displacement contact blades on the opposite end; and (d) connecting means for attaching said body and said cover plate to each other.

2. A connector of claim 1 including a jacking slot cut into the bottom edge of at least one side of said body.

3. A connector of claim 1 wherein said means for connecting said body and said cover plate comprises closely fitting metal or plastic pins for insertion into said apertures for housing said means for connecting said body and said plate.

4. A connector of claim 3 wherein said pins comprise pins having a square cross-section of corner-to-corner dimensions slightly in excess of the diameter of said apertures for housing said pins.

5. A connector of claim 1 comprising an electrically conductive metal.

6. A connector of claim 1 comprising an electrically conductive metal-coated plastic.

7. An assembly for connecting a shielded electrical signal ribbon cable to a printed circuit board (PCB) comprising:

(a) a shielded electrical signal ribbon cable terminated by insulated displacement contact to;

(b) a shielded impedance-controlled insulation displacement contact connector comprising:

(i) an electrically conductive body, including a top, a bottom, two opposing sides, a front, a back, a jacking slot cut into the bottom edge of each side of said body, said body having one or more rows of closely spaced first set of apertures passing through said body, top to bottom, the top portion of each said aperture being offset from the bottom portion of each said aperture to accommodate and center within each said aperture an irregularly shaped insulation displacement contact tine and insulation surrounding said tine housed therein, and a second set of apertures inlet into said body for housing connecting means to connect said body to (ii) a tine cover plate, including apertures for housing connecting means for connecting said plate to said body, apertures inlet into said plate to provide space above said tines protruding into said plate from said body to which said plate is affixed, and a slot inlet into the bottom surface of said plate to house, accommodate, hold in place, and ground a ribbon coaxial cable;

(iii) a multiplicity of insulation displacement tines surrounded at the middle portion of said tines by resilient insulation and housed within said first set of apertures in said body and protruding into said apertures in said cover plate, said tines having an offset irregular shape, including pins on one end and a pair of insulation displacement contact blades on the opposite end; and (iv) connecting means for attaching said body and said cover plate to each other, which is connected to (c) a PCB and held thereon by latching means.

8. An assembly of claim 7 wherein said latching means comprises:

(a) a connector receiver frame, including four sides which surround and enclose the bottom portion of an electrical connector having contact pins extending therefrom and attachment pins for attaching said frame to said PCB;

(b) a pair of latching clips affixed to said frame, one at each end thereof, and pivoted on pins set in apertures in said frame;

(c) said clips being configured to hold a connector in place within said frame and against said PCB.

* * * * *